US007140453B2

(12) United States Patent
Ayling

(10) Patent No.: US 7,140,453 B2
(45) Date of Patent: Nov. 28, 2006

(54) PIPE HANDLING APPARATUS

(75) Inventor: Laurence John Ayling, Camberley (GB)

(73) Assignee: Maris International Limited, Surrey (GB)

( * ) Notice: Subject to any disclaimer, the term of this patent is extended or adjusted under 35 U.S.C. 154(b) by 256 days.

(21) Appl. No.: 10/500,528

(22) PCT Filed: Dec. 30, 2002

(86) PCT No.: PCT/GB02/05940

§ 371 (c)(1),
(2), (4) Date: Jun. 30, 2004

(87) PCT Pub. No.: WO03/060287
PCT Pub. Date: Jul. 24, 2003

(65) Prior Publication Data

US 2005/0103526 A1 May 19, 2005

(30) Foreign Application Priority Data

Dec. 31, 2001 (GB) ..... 0131031.7

(51) Int. Cl.
*E21B 19/20* (2006.01)

(52) U.S. Cl. ..... 175/52; 175/85; 166/77.51

(58) Field of Classification Search ..... 175/52, 175/85; 166/77.51, 77.1, 85.1, 85.5
See application file for complete search history.

(56) References Cited

U.S. PATENT DOCUMENTS 5,404,944 A * 4/1995 Lynde et al. ..... 166/117.7
5,957,209 A * 9/1999 Burleson et al. ..... 166/380
6,725,938 B1 * 4/2004 Pietras ..... 166/380
6,732,822 B1 * 5/2004 Slack et al. ..... 175/423

* cited by examiner

*Primary Examiner*—Frank Tsay
(74) *Attorney, Agent, or Firm*—Bartlett & Sherer; Ronald B. Sherer

(57) ABSTRACT

An apparatus for moving and handling tubulars has a stinger (21) slidably mounted on a frame which stinger comprises a rod or tube the end of which is adapted to fit within the pipe (20) to be moved, a gripping means (23) on the end of the stinger which is inserted into the pipe end which gripping means is adapted to grip the pipe, a drive means (25) which drives a sc threaded sub (24) which drive means is adapted to slide along said stinger so that the screw threads on the sub can engage the screw threads on the end of the pipe and moving means adapted to move the sub and a pipe attached to the sub along the frame so that a tubular can be automatically removed from a container (10) or an ISO container transferred to a mast (13) the mast moved vertically above a drill head or well head and the tubular connected to the drill string in such a way that the cross section area of the stinger takes the majority of the well head pressure while the tubular is snubbed into the well using relatively little force.

17 Claims, 12 Drawing Sheets

Rating for full 40' container = 57,200 lbs
Typical tare for 40' container = 8377 lbs
Maximum payload therefore = 58823 lbs

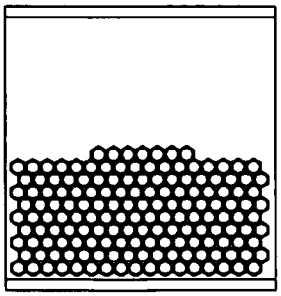

160 2-3/8" drillpipes
drillpipe = 40960 lbs
storage = 17567 lbs
58257 lbs

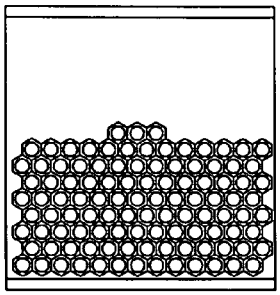

106 2-7/8" drillpipes
drillpipe = 42400 lbs
storage = 15899 lbs
58299 lbs

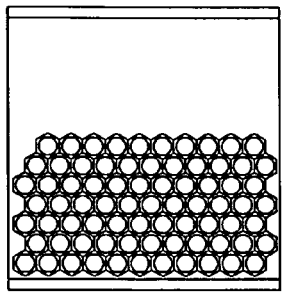

75 3-1/2" drillpipes
drillpipe = 44775 lbs
storage = 13521 lbs
58296 lbs

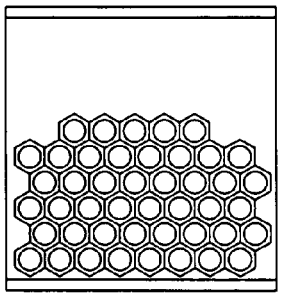

44 5-1/2" drillpipes
drillpipe = 41536 lbs
storage = 15168 lbs
57704 lbs

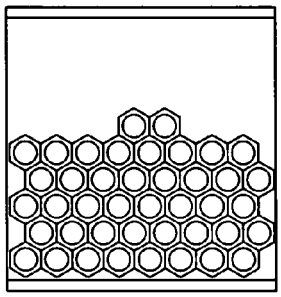

41 5-7/8" drillpipes
drillpipe = 41410 lbs
storage = 15477 lbs
56887 lbs

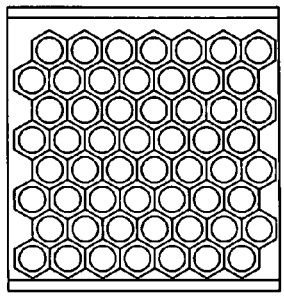

40 6-5/8" drillpipes
drillpipe = 41960 lbs
storage = 16305 lbs
58263 lbs

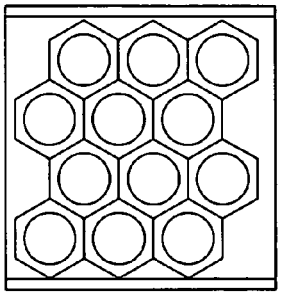

12 18-5/8" casings
tubulars = 40944 lbs
storage = 14456 lbs
55400 lbs

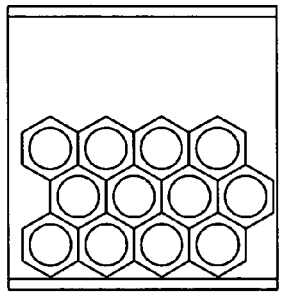

12 13-3/8" casings
tubulars = 45864 lbs
storage = 11050 lbs
56914 lbs

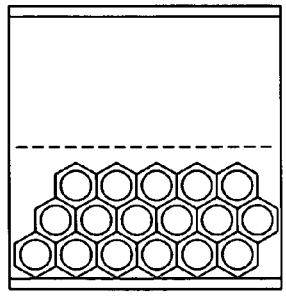

17 9-5/8" casings
tubulars = 47600 lbs
storage = 8386 lbs
55986 lbs

FIG. 3a

PIPE HANDLING APPARATUS

The present invention relates to a pipe handling apparatus used in drilling oil and gas wells.

When drilling for oil and gas, with a rotary drilling rig, the drill string is made up of lengths or joints of drill pipe. Each joint has a threaded male connection (pin) on one end and a female threaded connection (box) on the other end. These are known as tool joints and are designed for repeated make up and break out. After drilling a section of hole, of many hundreds of feet, the hole is line with pipe, called casing. The lengths of casing are joined together with threaded couplings, which are not designed for repeated making and breaking. To complete a well for production, a string of recoverable pipe, called tubing, is installed, which is also connected by threaded couplings. All tool joints and couplings have sealing surfaces which form pressure tight seals between the two halves of the connection, when connected.

When drilling, an assembly of heavy wall tubular components is run immediately above the drilling bit, called the bottom hole assembly (BHA). The production tubing includes components for controlling and monitoring the well production.

Conventionally, new tubulars, (generally of nominal length 30 ft and exceptionally 45 ft, in the case of drill pipe, but sometimes of 20 ft or 40 ft in the case of casing), are delivered to the drilling site from the supplier by road, rail and/or sea in bundles. The threaded tool joint and connector ends are protected by removable caps during transport and handling, but damage to these vulnerable extremities often occurs before the tubular is used within the rig or during transport between sites.

Conventionally also, new tubular completion assemblies are often made up in the yard and delivered to the rig site by road, rail and/or sea, in a variety of protective packages.

Once on the drilling site, the tubulars and tubular assemblies are individually handled by crane and the lifting gear of the rig. Handling within the rig involves stabbing each tubular pin into the box of the tubular below, which itself can cause damage.

Although the sealing surfaces and threads are frequently inspected, it is inevitable that some connections are made that are sub optimum due to damaged sealing surfaces or threads In the prior art there are various methods and devices for lifting tubulars to and from a drilling rig floor. One of such methods simply attaches a wire cable to the pipe and then the cable is lifted by a hydraulic winch which is typically mounted on a truck parked near the rig. Cranes have also been used to lift the pipe. Hydraulic driven chains have been successfully used too. Pipe transferred by these methods can be dropped on personnel or equipment below causing severe injury and damage inasmuch as they can weigh thousands of pounds. Often the pipe must be lifted to heights of forty feet or more. These dangers are more intense when the apparatus and rig are positioned offshore and subjected to wave, tidal and wind forces. If the pipe is dropped or banged against other structure the threaded ends can be easily damaged or the pipe bent.

Inclined troughs for the transfer of tubulars have also been used wherein the tubular is frictionally slid along the trough surface. This action often causes excessive wear on pipe especially the threaded ends which must be protected from such wear. It was thus often necessary to keep the metal thread protector on as the pipe was moved along the trough for removal when the pipe was on the drilling rig platform. This necessary care of the threads and pipe ends creates an extra step in the installation of the pipe or other tubular in the hole resulting in a longer cycle time.

Prior art troughs sometimes were designed to pivot from a generally horizontal position adjacent the pipe rack to an inclined position near the drilling rig floor.

However, no satisfactory means had been developed for supporting the uppermost end on the floor. Also, the pivoted trough lifting mechanism and the structural integrity of the trough limited the length of the trough, the angle of inclination and hence the ultimate lifting height. When the prior art transferring apparatus was used on offshore rigs, the wind, tidal and wave forces would act against the pivoting trough causing it to sway or to become out of alignment with the support means.

From a single drilling rig often 20 or more boles are bored. This requires that the tubular handling apparatus be moved around on the platform to position it near the hole being used. This is a time-consuming process and typically requires the use of additional moving equipment, e.g. cranes.

To transfer the pipe from the ground onto the prior art pipe handling apparatus also required a least two personnel manually to move or roll the pipe to the machine, a procedure that limits the pipe from being efficiently stacked. Space being at a premium on any offshore rig, the inability efficiently to stack the pipe presents a serious problem. Inclined conveyor systems had been used to handle tubulars in the past but they occupied such large amounts of valuable floor space that they are not in any substantial use today. Pipe handling systems and apparatus an described in U.S. Pat. Nos. 3,633,771, 4,426,182, 4,834,604 and 6,220,807.

When removing the drill string from the well, or 'tripping out', in order to change the bit assembly, for example, the tubulars are 'stood back' vertically within the rig, in sands of 1, 2 or 3 joints. However, no satisfactory means has yet been found of ensuring that the sealing surfaces and threads of the bottom ends, the vulnerable pins, are never damaged as they land on and slide over the drill floor.

After the hole is drilled, the move to the next site involves breaking down the drill string into single joints, which is labor intensive and time consuming. Surplus casing and tubing is returned to the supplier for inspection and restocking.

We have invented a new and complete system for the handling of tubulars and tubular assemblies that employs prior art ISO containers, container handling, well construction components and the 'Coupler' described in WO 00/22278.

According to the invention there is provided an apparatus for moving pipes which apparatus comprises (i) a stinger slidably mounted on a frame which stinger comprises a rod or tube the end of which is adapted to fit within the pipe to be moved (ii) a gripping means on the end of the stinger which is inserted into the pipe and which gripping means is adapted to grip the pipe (iii) a drive means which drives a screw threaded sub which drive means is adapted to slide along said stinger so that the screw threads on the sub can engage the screw threads on the end of the pipe and (iv) moving means adapted to move the sub and a pipe attached to the sub along the frame.

Preferably there is a sealing means between the sub and the stinger, whereby the well pressure is contained while the sub slides along the stinger when in drilling mode The frame preferably is incorporated in or is a mast and the stinger is preferably mounted on a stinger carriage which can slide along the frame or mast, the sub is preferably driven by a drive carriage which can slide along the stinger and there is a rotary seal between the sub and the drive carriage and a reciprocating (axial) seal between the drive carriage and the stinger.

There is preferably a guide which supports and centralises a tubular whilst it is pulled onto the stinger and whilst it is being transported.

In use with a pipe stored in a container, such as an ISO container, the stinger is aligned with the end of the pipe and slid along the frame until the gripping means are within the pipe, the gripping means are then activated to grip the pipe from the inside, the sub is slid along the stinger until its screw threaded end engages the screw threads on the pipe, the sub is then spun so that the pipe is connected to it, the stinger can then be disengaged and the pipe can then be withdrawn from the container and is supported on the frame. When the pipe is to be attached to a drill string, the frame is positioned so that the end of the pipe is above the end of the drill string and the end of pipe pushed or snubbed against the end of the drill string as in conventional drilling for example in a coupler.

Preferably there is mast and gantry which supports the stinger, drive and guide in both drilling and warehousing modes and the stinger assembly comprising the stinger, driving means and subs is mounted on a mobile mast which is supported by the mobile gantry. The stinger carriage can move axially along the mast e.g., for six feet.

In the warehousing mode the mast is horizontal and the stinger accesses a tubular within the ISO Container by moving in an XY matrix (X horizontally and Y vertically) so that the tubulars can be removed or added to an ISO container. In the drilling mode the mast containing the tubular is raised to the vertical position and the end of the tubular positioned over the well head.

In the apparatus of the present invention the mast can pick up a stinger assembly of the correct size and then move it to any position so that it can operate either in drilling mode vertically above the well head assembly, or operate in warehousing mode horizontally across the faces of the open ISO Containers.

One important aspect of the handling mechanism of the present invention is that the 'stinger', which is preferably a long and very stiff thick walled pipe and along which the 'drive' slides and to which the drive seals, allows the tubular to be pushed or 'snubbed' into the well against the full pressure rating of the well head, without any risk of buckling the tubular. This also reduces the force necessary to snub the tubular into the well bore by some 80 to 90%.

The stinger also serves to penetrate each tubular or tubular assembly stored in an ISO container, grip it from the inside, read any internally installed data tag or bar code, restrain it while the 'drive sub' is slid for spun in and connected, and support the tubular or tubular assembly, while it is withdrawn from the ISO container, until it is safety aligned to, and centred on, the string within the 'Coupler'.

The total system can be fully mechanised and repetitive activities can be fairly easily automated. The system has also been designed so that it is relatively easy to put the total rig under water, with a view to utilizing it as a 'seabed located rig' in water depths down to 20,000 feet. Several aspects of operating this system are easier under water than on land, such as using buoyancy to support weight and eliminating fire and explosion risk.

Whereas the ISO Container is an established International Standard means of transporting and storing equipment and materials, no standard form of containing tubulars is known. We have devised a simple range of internal layouts for a standard ISO Container, useful with the present invention such that all tubulars and tubular assemblies needed for the drilling of oil and gas wells, can be transported and stored in ISO containers in such a way that tubulars and tubular assemblies can be protected and easily accessed when required.

Regarding Container length, the most popular and economic units are the 20 ft and 40 ft ISO Containers. 10 ft and 30 ft are also ISO standards but less popular and less economic overall. The vast majority in worldwide use are 8 ft 6 ins high by 8 ft wide and are the most economic. There are millions of 20 ft and 40 ft, 8 ft 6 ins high by 8 ft wide containers it use worldwide and thousands of road, rail and sea terminals capable of handling these sizes.

Regarding Container weight, the common ISO standard for 40 ft containers is a 'gross weight' or 'all-up-weight' of 30 tons; consisting of a typical 'tare weight' of about 4 tons plus a resulting maximum 'payload weight' of about 26 tons (Some Countries reduce the 'gross weight' allowed when transported by road.)

Whereas the length of drill pipe is most commonly an API standard 'Range 2', being a nominal length of 30 ft (ranging from 27 to 30 ft), a nominal length of 40 ft is also in use and is known as Range 3 (ranging from 38 to 45 ft.). By limiting the 'acceptable' range to 38 to 39½ ft, "Limited Range 3" tubular could be transported and stored in 40 ft ISO containers.

Indeed all tubulars and all tabular assemblies could be "Limited Range 3". Only bit assemblies and certain 'specials' need to be shorter but these can also be stored in 40 ft ISO containers, by reversing the ISO container to access both ends or by increasing the travel of the stinger to reach further into the ISO container.

Analysis of the capacity of 40 ft ISO containers shows that, for the majority of tubulars needed to drill a 12,000 ft deep well say, the ISO containers are generally only half full when the weight limit is reached. This being the case, the optimum 40 ft ISO container could be a "half height", as they are called; i.e. 4 ft 3 ins high, thus allowing 2 to be stacked to equate to the height of a regular ISO container for economic use of space on site and at sea. (Though not on road and rail, where weight is restricted; but where, however, the lower centre of gravity of a "half height" is an advantage).

The 40 ft ISO containers would be opened at both ends, which is also an ISO standard, to allow inspection of both ends of the tubulars. The doors fold back flat and locked so that the ISO containers can then be stacked close together on a pre planned 'base structure'. This then allow both ends, pins and boxes, to be easily accessed for cleaning, inspection and applying thread lubricant. It also enables a machine, such as a stinger mounted on a mast and gantry, to relate the exact position of the ISO and its contents for mechanised or automated warehousing.

At the end of the plastic tubes, the wall thickness of the tubes can be increased and the foam can be faced in plastic and welded to the tubes for additional strength where the steel tubulars could exert considerable point loading if not aligned with the plastic tubes.

The word plastic includes polymers, reinforced polymers and composites such as glass fiber reinduced plastic etc. which posses adequate properties for the storage tubes. The word foam is intended to mean foamed polymers such as foamed polyurethanes, polyethers etc.

The proportion of the space to be filled with foam depends mainly or the optimum transmittal of the weight of the steel tubulars, via the plastic tubes to the ISO container base and walls.

Whereas the ISO container doors will be opened at both ends before the ISO is stacked on the be structure, a secondary sealing surface is preferred to maintain a clean environment around the tubulars during transport and when access is not required. This secondary sealing surface need not be structurally strong like the doors but, preferably, can roll up, like a roller blind on the back of a road van, into the vacant space above the tubular storage within the ISO.

Each ISO container carries electronic tagging that can be scanned by sensors on the mast carriage and which identifies the type of storage array inside and the serial number that will tie up with data concerning its specific contents.

Since each re-usable drill string tubular will now have a permanent 'address' it will be far easier to log its history and record its actual length, number of make-ups/disconnects, at what torque, what position in the string, etc. (ISO containers carrying casing can be returned when empty to be refilled at the nearest depot).

The X Y storage/warehousing system enables the Drilling System to be programmed to follow a series of automated well construction sequences under the remote control of the Driller and Drilling Crew.

Flexibility exists to manually make up bit assemblies, production assemblies and other special intervention assemblies into 40 ft lengths on site and then insert them into an ISO, by using the site crane or fork lift, for subsequent extraction by the stinger assembly and insertion into the well bore.

This invention achieves the complete mechanisation of the handling of all tubulars and tubular assemblies, from their specific designated locations within particular ISO containers, to the well bore and, in the case of the drill string tubulars, back to their designated locations within the ISO containers. Thus, it is now possible to monitor and record automatically the location of all tubulars and long sequences of options can be more easily automated and computer controlled in the interests of faster, more efficient and safer drilling.

It is assumed that a Coupler is being used (a device tat allows mud circulation to continue while tool joint connections are being made or broken) such as described in WO 00/22278. This reduces the drilling downtime when tubulars are added to the drill string, and improves the efficiency of repeatedly making good tool joint connections; so that there is no overall advantage in drilling with stands of 2 or 3 joints of drill pipe (doubles or triples).

In this invention, joints of drill pipe of 40 ft nominal length can be used. The possibility of extracting the drill string in doubles, while tripping out of the hole, i.e. stands of 2 joints each, is not thought to be worth while if a Coupler is being used, also, the mast and stinger can be limited to some 50 ft in length, instead of about 90 ft. Nor is it worth 'standing back' joints of drill pipe in a vertical stack when tripping out of the hole, since it is just as easy and simpler to store the tubulars in the ISO containers.

As designed in this invention, the overall maximum height of the rig is the height of the wellhead assembly plus about 50 ft, which is very much lower than conventional rigs.

The mast and gantry together an likely to be of less weight than a conventional rig and easier to pack up into road transportable 30 ton loads.

The ISO containers add additional weight to be transported but this is totally outweighed by the many technical and economic advantages of using ISO containers.

The wellhead assembly and all other auxiliary drilling equipment are conventional state-of-an-equipment.

This invention essentially mechanises the handling of all tubulars from an organised storage system within ISO containers to the wellhead and back for complete remote control. As such, this invention facilitates the placing of the rig under water, on the seabed in water depths down to 20,000 ft The ISOs can be made neutrally buoyant using the appropriate syntactic foam filling and can naturally 'float' in the vertical. They can be flown by work ROV to the seabed location.

The doors would be locked open on top and closed beneath, the tool joints having already been inspected and prepared on board the support vessel, before launching through the moon pool.

The main adaptation of this invention is that the stinger and mast can remain the vertical at all times and the X Y axes for accessing the tubulars are both horizontal.

The base structure, with adjustable feet, standing on the seabed instead of on land, would support the ISO containers in the vertical instead of the horizontal.

This invention reduces the need for a rig structure sufficiently to facilitate the housing of all rig components within ISO containers or within the same space and corner fittings of an ISO container. Hence all parts of a drilling rig designed in accordance with this invention would be capable of deploying and recovering through a typical moon pool of an average seagoing surface support vessel.

Such a seabed rig connected by compliant risers, to its surface support vessel, would inevitably be considerably less expensive to build and operate than a Deep Water Drill Ship connected to its wellhead by a rigid drill string (with or without a rigid return riser).

The invention is illustrated in the drawings in which:

FIGS. 3*a* and 3*b* show various storage capacities for different size tubulars in containers.

Figure 1:
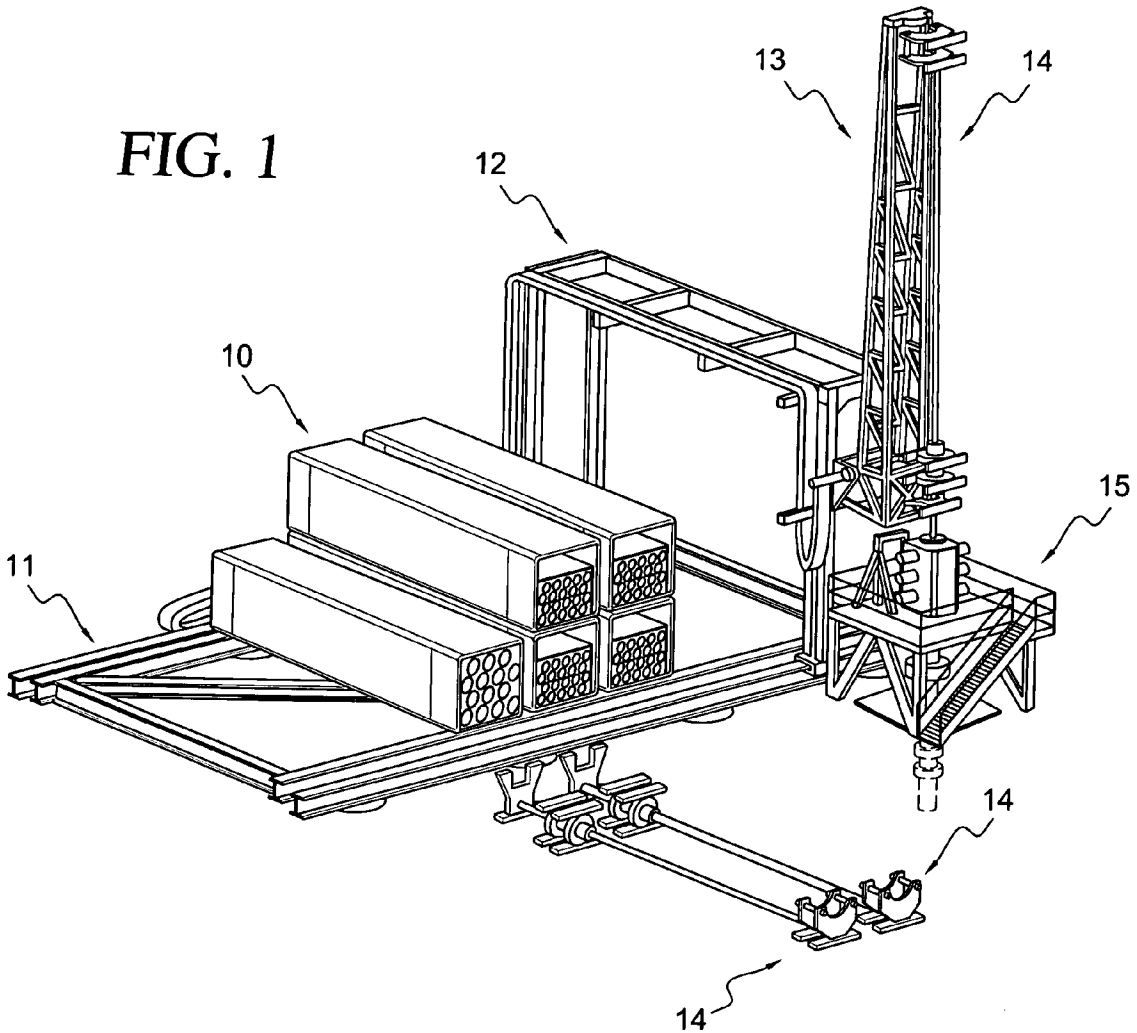
FIGS. 1 and 2 show an overall view of a tubular handling system incorporating the invention
Figure 2:
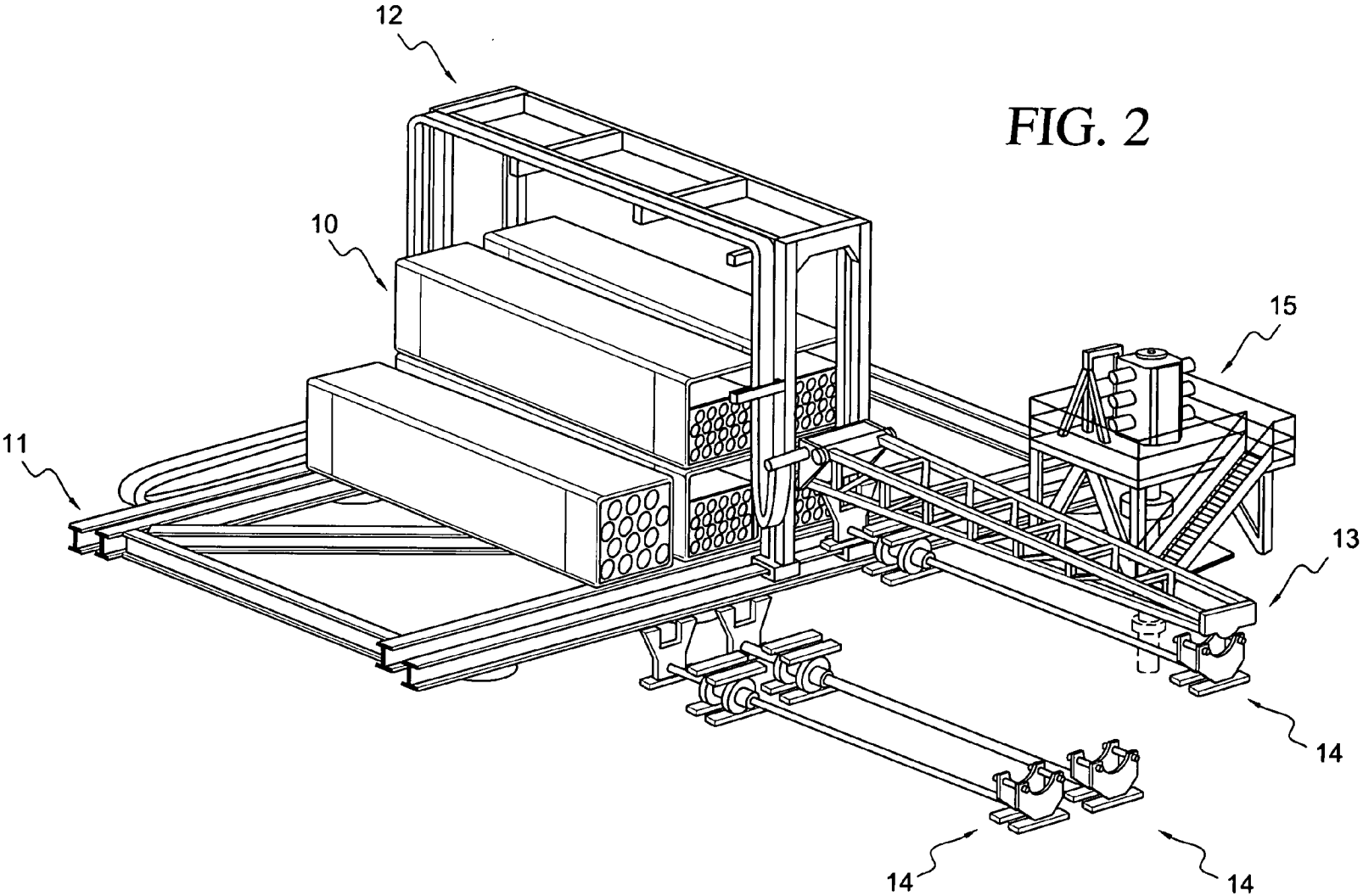

Referring to FIGS. 1 and 2 there is a well head assembly (15) and standard ISO Containers (10) fitted out to contain all tubular and tubular assemblies used in drilling, positioned on a base (11), which also supports the mobile gantry (12), on which is mounted the mobile mast (13). There is a stinger assembly (14)

The mast (13) can pick up a stinger assembly (14) of the correct size as in FIG. 2 and then operate either in drilling mode vertically above the well head assembly (15) as in FIG. 1, or operate in warehousing mode horizontally across the faces of the open ISO Containers (10) as FIG. 2.

Figure 3B:
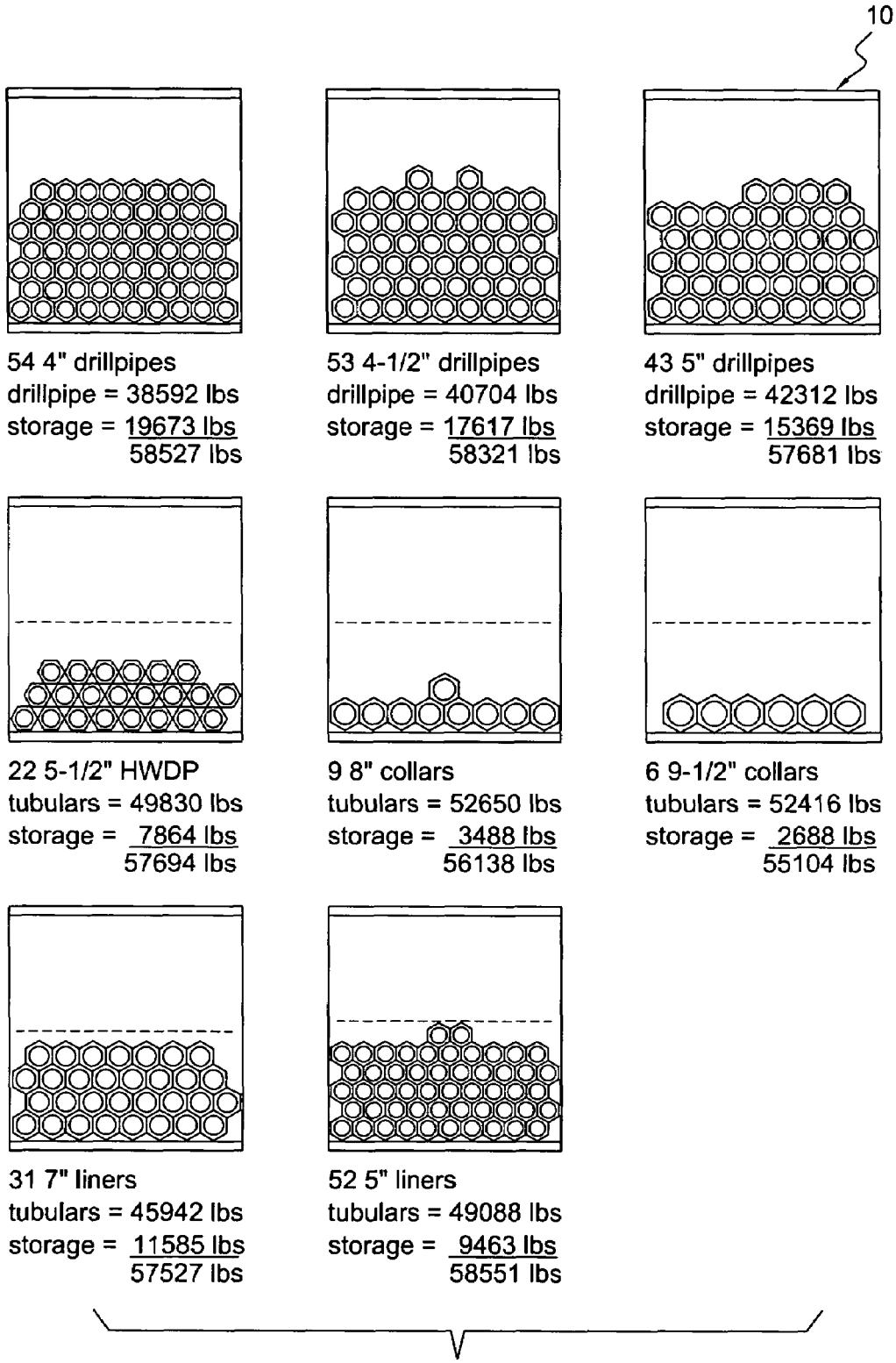
Figure 4:
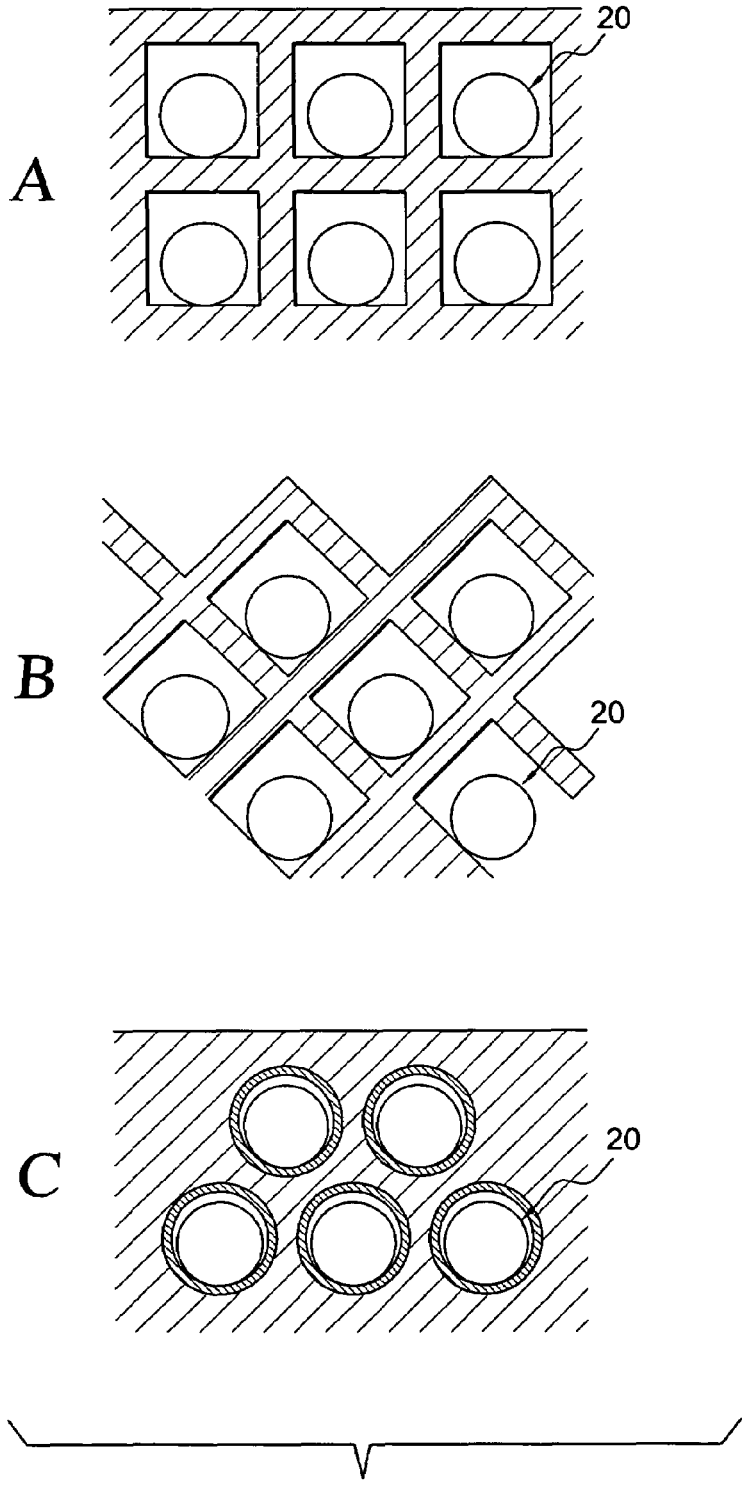
FIG. 4 shows various arrangements for storing tubulars in ISO containers

Referring to FIG. 3 it can be seen that the loading and weight of various configuration of pipes can fit easily into ISO containers with considerable space to spare. Referring to FIG. 4 the arrangement of 4A shows a straight forward rectangular packing, FIG. 4B shows a diagonal packing arrangement and FIG. 4*c* shows the use of foam. For transportation purposes, there is advantage in using a diagonal lattice or tubes in order to avoid lateral movement during transporation, skin to many racks that store bottles of wine as in FIG. 4B. The preferred solution, however, is to set lightweight plastic tubes in a foam and the preferred array for these tubes is the honeycomb or hexagonal array as shown in FIG. 4C, with each tubular being above and between the two below.

At the end of the plastic tubes, the wall thickness of X tubes can be increased and the foam can be faced in plastic and welded to the tubes for additional strength where the steel tubulars could exert considerable point loading if not adequately aligned with the plastic tubes.

The Stinger & Stinger Carriage and The Drive

Figure 5:
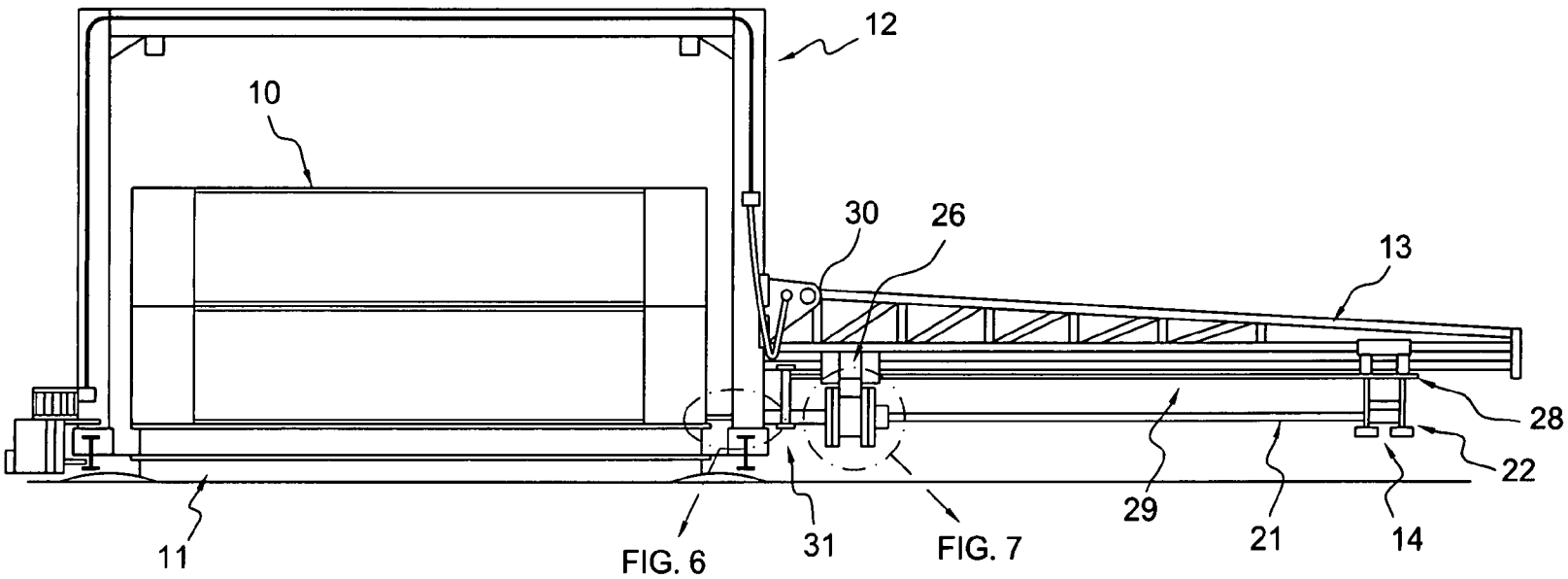
FIG. 5 shows the stinger arrangement.
Figure 6:
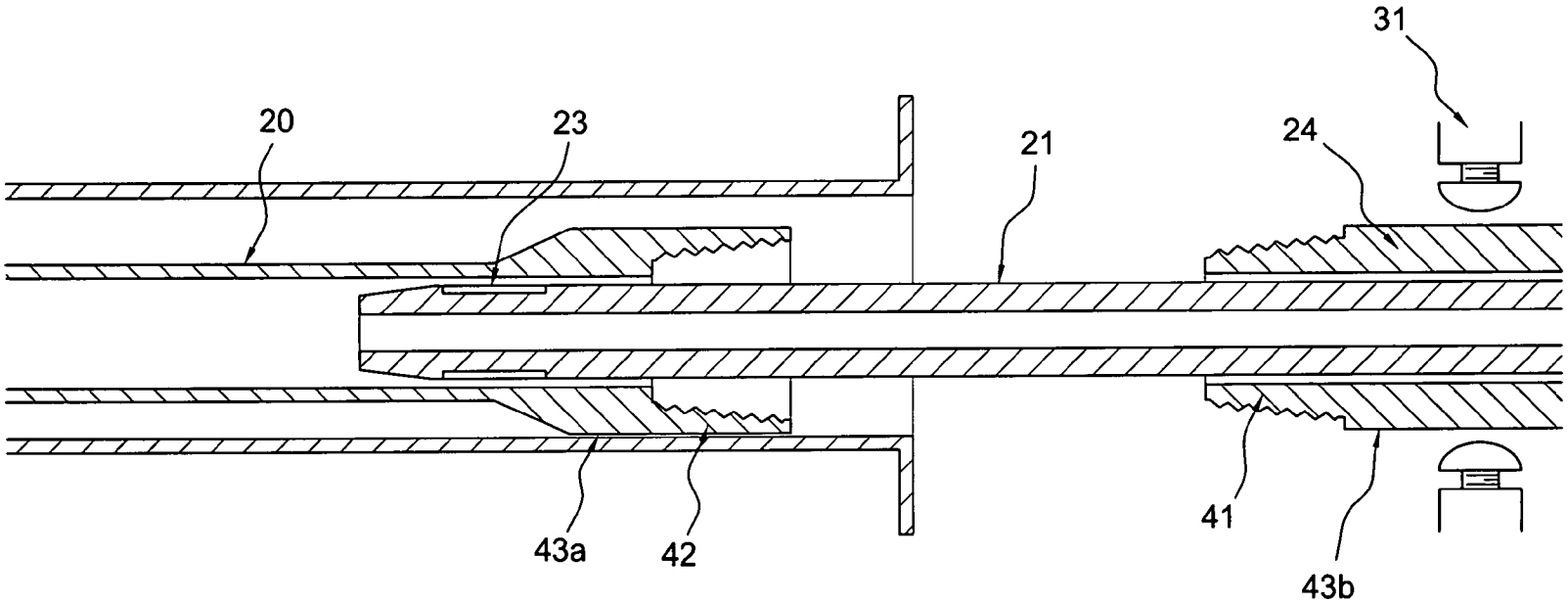
FIGS. 6 and 7 show enlarged sections of FIG. 5
Figure 7:
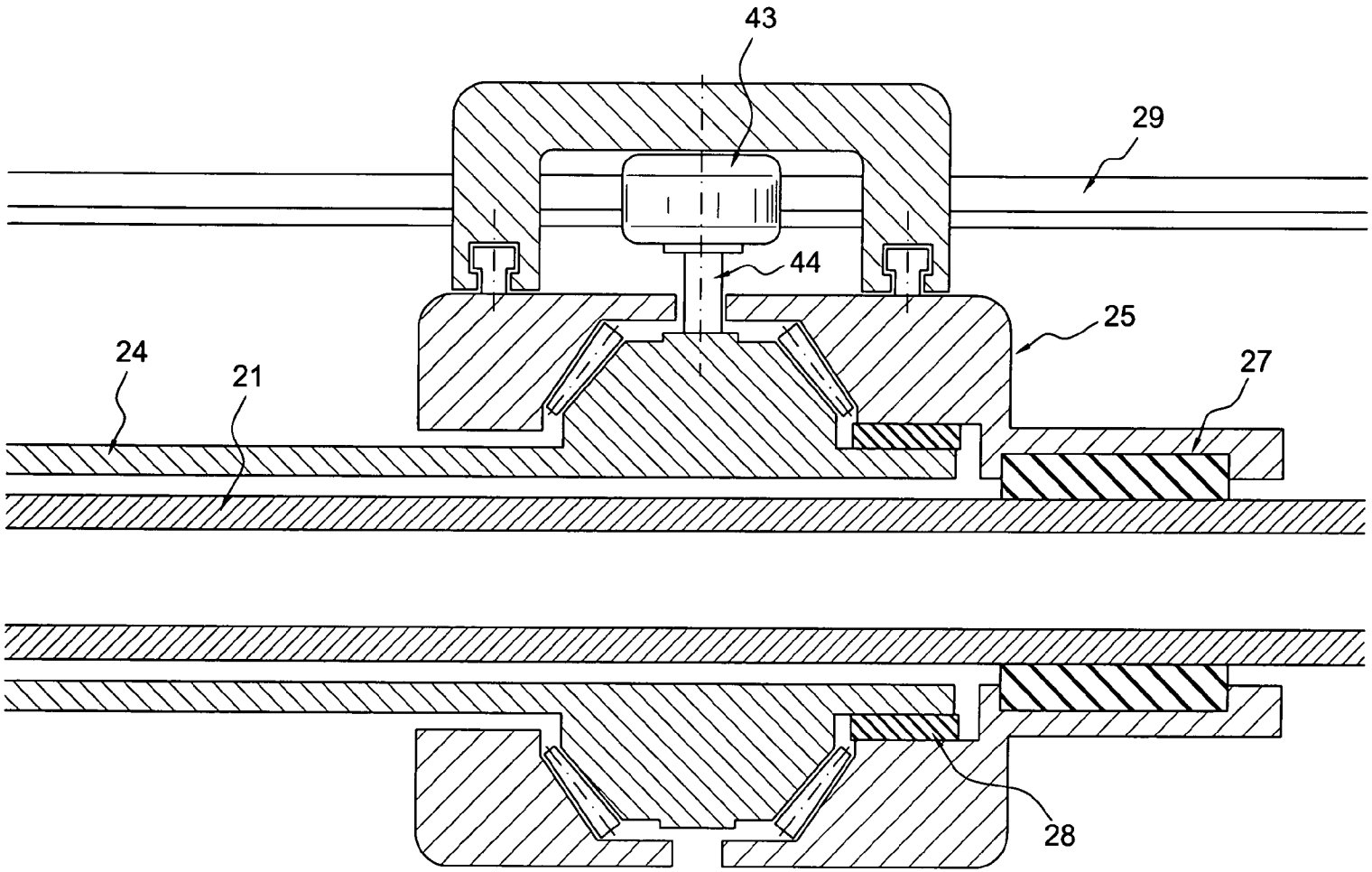

Referring to FIGS. 5, 6 and 7—the stinger assembly (14) consists of the stinger (21), Drive (25) (FIG. 7) and Guide (31).

The stinger (21) is connected to the mast (13) by the stinger carriage (22), which can move some 6 feet, or more, axially along the must (13), in order to insert the stinger (21) into a tubular (20) stored within an ISO container (10) (FIG. 6). The stinger (21) has grips (23) at it tip, with which to grip the inside of the tubular (20) with sufficient force to restrain it while the Sub (24) is spun in and connected (FIG. 6). The gripping mechanism is mechanically, hydraulically or electrically activated and can grip a small range of internal diameters, so that only about 3 different stinger. Assemblies are required in order to encompass all drill pipe from 3½ to 6⅝ inches.

The Sub (24) is rotated by the Drive (25) (FIG. 7) which is driven through the Drive care (26), which itself slides along the finger (21) and seals to it. When the Sub (24) has been connected to the Tubular (20) stored in the ISO container (10), the stinger (21) ceases to grip the Tubular (20) and the Drive (25) then slides along the stinger (21) pulling the tubular (20) out of storage and onto the stinger (21).

The Guide

The Guide (31) (FIG. 6) is a centralising guide, designed to assist in supporting the tubular (20) as it is being pulled onto the stinger (21) and while it is being transported to the vertical drilling mode. It is designed to centralise for diameters ranging from the OD of the tubular tool joint (43) (FIGS. 6 and 7), down to the OD of the stinger (21), (by any of several commerically available prior art methods).

Figure 9:
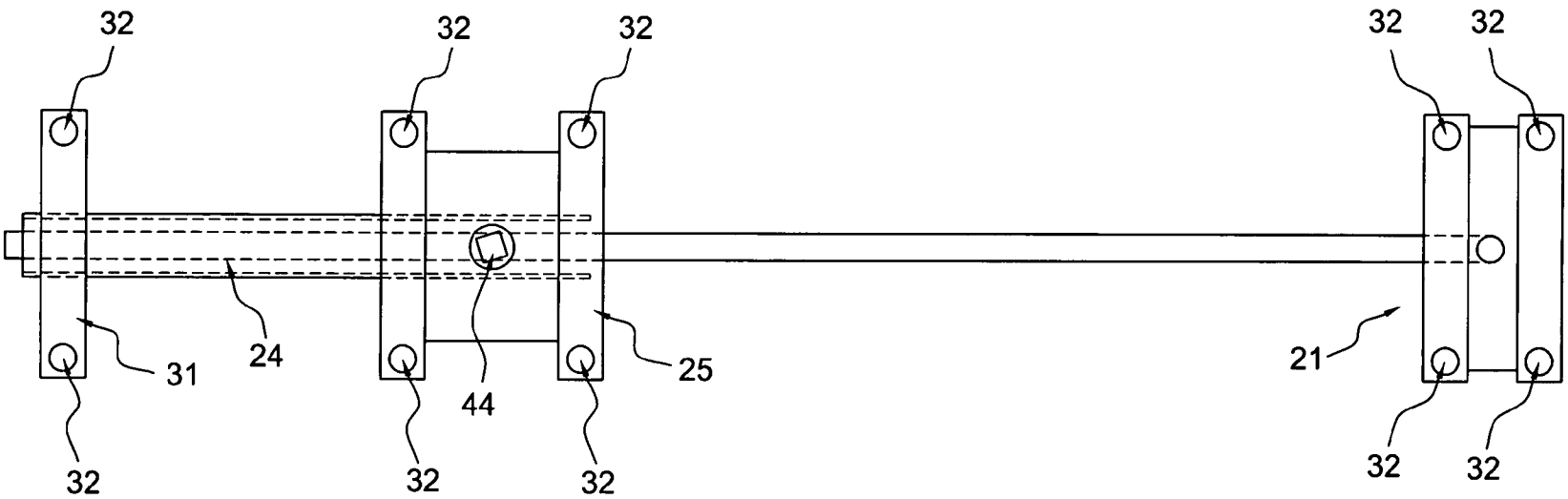
FIG. 9 shows details of a guide system of FIG. 5

Referring to FIG. 9 the Guide (31), Drive (25) and stinger (21) connect to the mast (13), Drive carriage (27) and stinger carriage (22), respectively, by connectors (32), so that alternative stinger. Assemblies can be connected to the mast to cater for different ranges of tubular diameter (E.g. 3½" to 4", 4½" to 5", 5½"to 6⅝").

Figure 10:
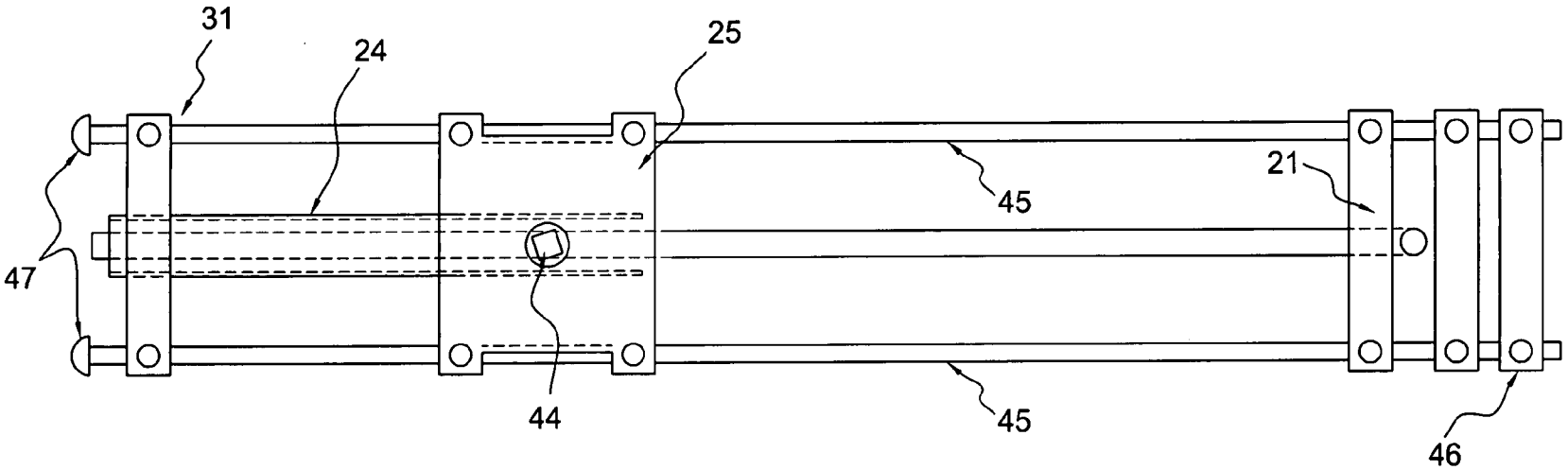
FIG. 10 shows another guide system of FIG. 5.

A preferred alternative is shown in FIG. 10, whereby the stinger assembly has two guide shafts (45) connecting the backstop (46) directly to the wellhead assembly (15) via the wellhead assembly Connectors (47). The axial forces caused by mud pressure, in FIG. 8 would thereby be transferred directly to the wellhead assembly (15) without past thorough the mat (13). These Connectors (47) are either side of the wellhead centre line so that there is no bending moment on the mast (13) due to these axial forces. These guide shafts also assist in maintaining the alignment of stinger assembly components, Guide (31), Drive (25) and stinger (21), as the stinger assembly (14) is connected to the mast (13).

Figure 11:
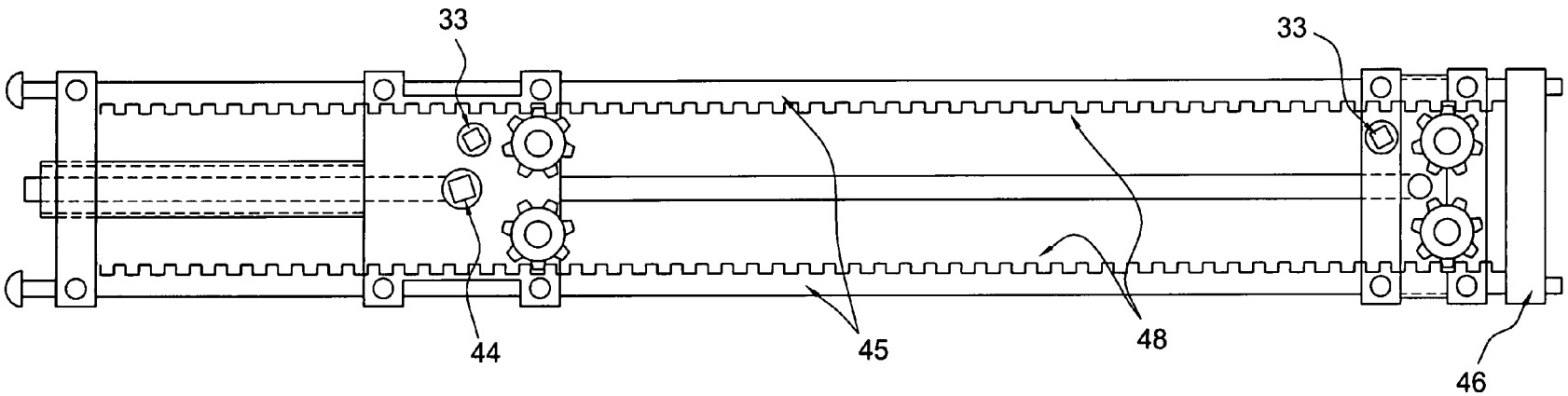
FIG. 11 shows a further guide system of FIG. 5

A further option is shown in FIG. 11, wherein the Drive (25) is designed to engage racks on the guide shafts (45) so that the force necessary to support the drill string is transferred directly to the wellhead assembly (15) via the wellhead assembly connectors (47) without passing through the mast (13). This requires extra drive shafts (33) to provide the motivation. In this design the guide shafts (45) must be capable of withstanding a high compressive, and potentially buckling, force. If this is so designed, the mast (13) avoids all axial forces due to mud pressure or drill string weight and only has to resist the torsion forces of the Drive, while in the Drilling Mode. The mast (13) has nevertheless to be capable of withstanding the bending moment of the weight of stinger assembly and Tubular, when horizontal in the Warehousing Mode.

The Drive Carriage

The Drive (25) slides along the stinger (21) with a high pressure seal (27) FIG. 7, which is required to slide axially; not rotationally. The stinger (21) and Drive (25) do not themselves rotate. The Drive (25) rotates the Sub (24) and there is a high pressure seal (28) between the Sub (24) and Drive (25) which slides rotationally, not axially.

The size and weight of the Drive (25) is minimised by including only the gearing to transit torque from the drive shaft (29) under the mast (23) to the Sub (24) via the bushing (43) (FIG. 7) and drive shaft (or spline) (44). The motor (30) providing the torque is mounted close to the fulcrum of the mast (13); as is also the motor (45) for the Drive carriage (26), which replaces the conventional draw-works.

The drive shaft (29), which provides torque to the drill string is akin to the conventional Kelly, with the Kelly bushing rising and falling, instead of the Kelly.

The Drive carriage (26) can be driven along the length of the mast (13) by wire rope conventionally, or by a hydraulic motor or hydraulic ram or electrically. The preferred method is to use an electrically driven pinion in the carriage (26) acting on a rack attached to the mast (13), since this is a preferred method to drive the mast carriage on the gantry and also the gantry carriages on the Base.

The Mast and Mast Carriage

In use when in Warehousing Mode, the mast (13) moves in an X Y system to access the particular slot in the ISO containers with adequate precision to insert the Stinger (21) without touching the threads of the tubular's box (42) (FIG. 6).

Referring to FIG. 5, The mast (13) is mounted on the mast carriage which moves vertically (Y axis) on the side of the gantry, which itself moves horizontally (X axis) on its gantry carriages.

Figure 8:
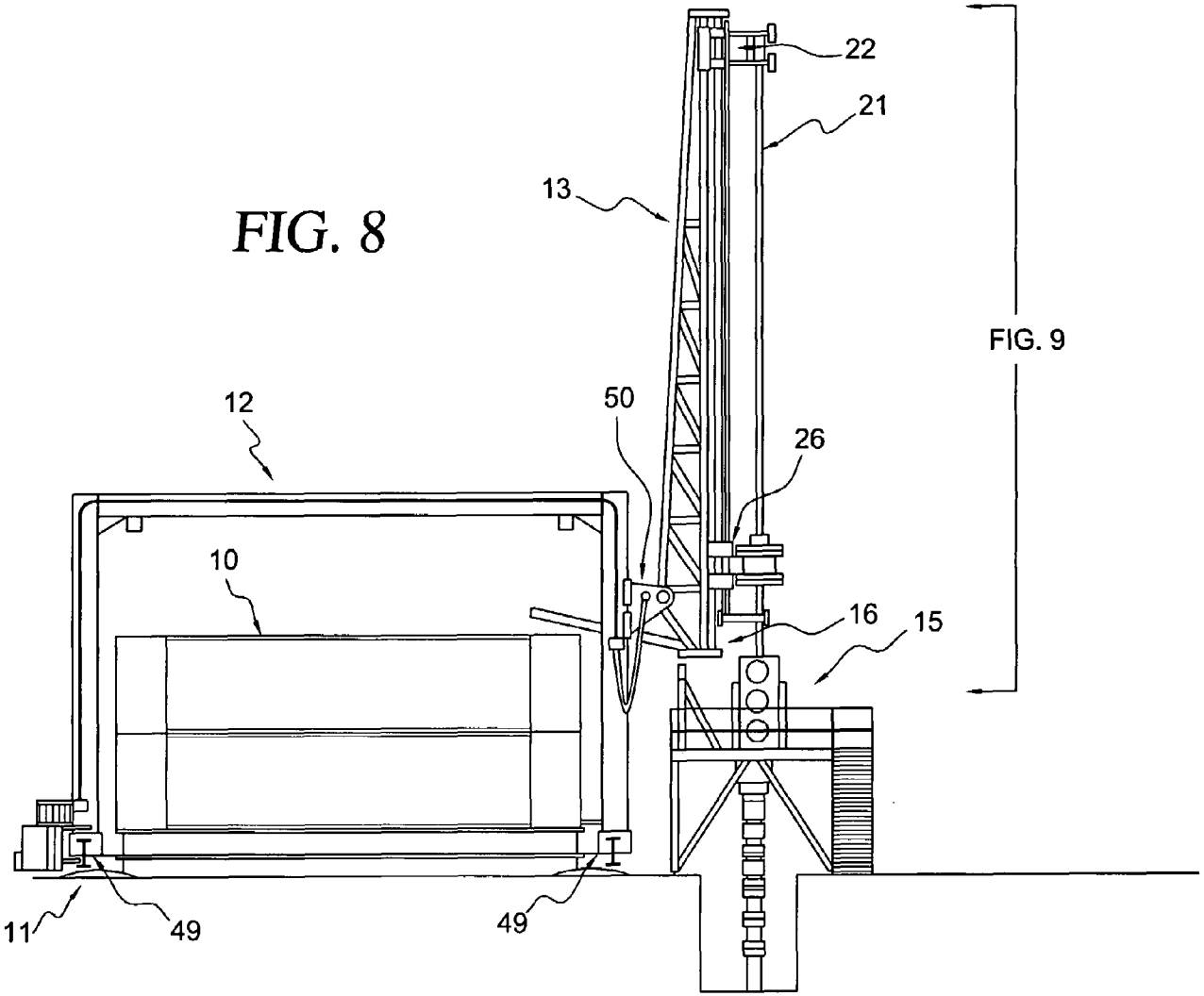
FIG. 8 shows the addition of a tubular to a well head assembly

Referring to FIG. 8, The mast (13) locks into the wellhead assembly (15) at position (16), as it moves sideways into location above the wellhead assembly (15). Thereby, when the mast (13) is in a Drilling Mode, the vertical and rotary forces transmitted by the Drive carriage (26) and stinger carriage (22) are, to a large extent, transferred back to the wellhead.

Thus the stinger (21), shown in FIG. 5, serves the following purposes:

- To access a tubular (20) within an ISO contain by penetrating it and gripping the inside of the tubular.
- To hold the tubular (20) stationary and centre the Drive saver-sub (Sub) (25) on the tubular box, while the Sub pin connects or 'makes up' to the tubular (20).
- To release its grip on the made up tubular and retract to its backstop
- To allow the Drive to withdraw the tubular from the ISO container onto the stinger To withstand the mud pressure of as much as 5,000 psi, which can produce an axial load an the stinger of as much as 70 tons, while the Drive pushes or 'snubs'; the tubular into the wellhead, with a force of considerably less than 10 tons.

To provide a smooth sealing surface for the Drive's high pressure seal to slide along.

To pass drilling fluid into the tubular once it is sealed into the wellhead by the 'Connector' and eliminate the long conventional 'Kelly hose'.

The travel of the stinger carriage of about 6 ft, is sufficient to reach the shortest tubular at 38 ft and penetrate it beyond the box 42, before gripping it, plus an additional distance of about 2 ft to enable the stinger to push the tubular (20) out of the far end of the ISO container (10) for cleaning & inspection etc.

The Gantry and Gantry Carriages

FIG. 8 shows the gantry (12), which travels laterally along the line of stored ISO containers on gantry carriages (49) running on the rails of the Base Structure (11). The gantry (12) serves both to support the mast carriage (50) and to position and re-position ISO containers (10).

With the minimum Drilling System, one gantry (12) supporting one mast (14) is sufficient to drill a well and the positioning and re-position of ISO containers (10), can be carried out by the site crane or by the gantry with a relatively small interruption to the drilling.

The optimum Drilling System may have two Gantries and two masts, working alternately over the well, with plenty of time available for the non-drilling gantry and mast to carry out warehousing. The Gantries also provide the means of access to inspect, clean and lubricate the tubular threads of the pins and boxes at both access of each ISO container; either manually or by machine. Tripping out of the hole and back into the hole can attain maximum speed by using two masts mounted on two gantries, working alternately over the well.

As much possible, all of the electric, hydraulic and/or internal combustion motors of the Drilling System are located on the far side of the ISO containers away from the well, with the transmission drives crossing over the gantry and onto the mast. The mast and stinger assembly are kept as simple and light as possible in order to minimise energy loss, fatigue and wear.

Tubulars and Tubular Assemblies included all component that are normally introduced into the well bore, including drill pipe, drill collars, casing, liners, tubing, drill bits and assemblies. MWD components, coring components and fishing tools.

A String consists of a plurality of Tubulars and/or Tubular Assemblies connected together and located within the well bore, drilled or being drilled.

The invention claimed is:

1. An apparatus for moving pipes in a well which apparatus comprises:

(i) a stinger slidably mounted on a frame which stinger comprises a rod or tube the end of which is adapted to fit within the pipe to be moved;

(ii) a gripping means on the end of the stinger which is inserted into the pipe and which gripping means is adapted to grip the pipe;

(iii) a drive means which drives a screw threaded sub which drive means is adapted to slide along said stinger so that the screw threads on the sub can engage the screw threads on the end of the pipe; and (iv) moving means adapted to move the sub and a pipe attached to the sub along the frame.

2. An apparatus as claimed in claim 1 in which there is a sealing means between the sub and the stinger, whereby well pressure in the well is contained while the sub slides along the stinger when in drilling mode.

3. An apparatus as claimed in claim 1 in which the frame is incorporated in or is a mast.

4. An apparatus as claimed in claim 1 in which the stinger is mounted on a stinger carriage which can slide along the frame or mast.

5. An apparatus as claimed in claim 1 in which the sub is driven by a drive carriage which can slide along the stinger and there is a seal between the drive carriage and the stinger.

6. An apparatus as claimed in claim 1 in which the sub is driven by a drive carriage which can slide along the stinger and there is a seal between the sub and the drive carriage and between the drive carriage and the stinger.

7. An apparatus as claimed in claim 1 in which there is a guide which supports and centralizes a tubular while it is pulled onto stinger and while it is being transported.

8. An apparatus as claimed in claim 3 in which the mast can be moved by a gantry from a horizontal position to a substantially vertical position.

9. An apparatus as claimed in claim 8 in which when a tubular is removed from a container onto the frame there are means to move the frame over a well head so that an end of the tubular is positioned over the well head and there are joining means whereby the tubular can be connected to the well string in the well head.

10. An apparatus as claimed in claim 9 in which there is a reader means incorporated in the end of the stinger inserted in the pipe whereby information contained on the inside of the pipe can be read.

11. An apparatus as claimed in claim 1 adapted to receive an ISO container and locating means to locate the container so that a tubular contained in the container can be lined up with the stinger so that the end of the stinger can be inserted into the tubular.

12. An apparatus as claimed in claim 11 in which the tubulars are stacked in the ISO container in a diamond formation and in contact with a foam protective layer.

13. An apparatus as claimed in claim 11 in which the tubulars are stored in the ISO container in a diamond formation within pipes set in foam within the ISO container.

14. An apparatus as claimed in claim 1 which the stinger can withstand the majority of the force caused by the pressure within the well head, while the tubular is "snubbed" in the well head with a relatively small force.

15. An apparatus claimed in claim 11 wherein all tubulars and tubular assemblies including all components normally introduced into a well bore are stored and transported to the well head area within ISO containers and from ISO containers to the well head by stingers of a plurality sizes.

16. An apparatus claimed in claim 15, wherein the whole operation can take place under water.

17. A apparatus claimed in claim 16, wherein the ISO containers remain in the vertical from launching into the water to being landed on the scabbed base structure and the X Y axes, for accessing the tubular stored in the ISO containers, are both horizontal and the stinger and mast must remain in the vertical for both drilling and warehousing modes.

* * * * *